United States Patent [19]

Kanada et al.

[11] 4,378,541

[45] Mar. 29, 1983

[54] TIME DELAY SWITCH

[75] Inventors: Hiroshi Kanada, Hisai; Hiroshi Yamagiwa, Matsusaka, both of Japan

[73] Assignee: Matsushita Electric Works, Ltd., Kadoma, Japan

[21] Appl. No.: 208,347

[22] Filed: Nov. 19, 1980

[30] Foreign Application Priority Data

Nov. 30, 1979 [JP] Japan ..... 54-156195

[51] Int. Cl.[3] ..... H01H 43/02

[52] U.S. Cl. ..... 335/61; 335/63

[58] Field of Search ..... 335/59, 60, 61, 62, 335/63

[56] References Cited

U.S. PATENT DOCUMENTS

| | | | |
|---|---|---|---|
| 3,689,855 | 9/1972 | Setone et al. | 335/63 |
| 3,944,955 | 3/1976 | Thornley | 335/61 |
| 4,238,749 | 12/1980 | Lawson et al. | 335/63 |

*Primary Examiner*—George Harris

*Attorney, Agent, or Firm*—Cushman, Darby & Cushman

[57] ABSTRACT

In a time delay switch comprising:

a delay action means comprising an oil dash pot (9) containing a piston (21) of magnetic-flux-responsive substance disposed in an oil-filled cylinder, a magnetic circuit containing a permanent magnet (18) mechanically linked to a handle (8) and magnetically coupled to said piston (21), at least a fixed magnetic yoke (14, 15), at least a moving magnetic yoke (16, 17) and an armature (20) movable in reaction to a change of magnetic flux due to movement of the piston (21), at least a moving contact plate (13) linked to said armature (20) and at least a fixed contact plate (11) disposed to touch said moving contact plate (13), the improvement is that a case (1) which contains the abovementioned components is made of an insulating resin and has a first part (101) of larger depth and a second part (102) of smaller depth, said first part and said second part being each other integrally connected, said first part containing said oil dash pot fixed to said bottom part of said case (1), said handle (8) cradlably fulcrumed on an upper part of said first part (101), and said moving contact plate (13) and said fixed contact plate (11) of said time delay switch, said second part (102) containing terminals **(24,24*c*,25,25*c*)** to which electric wires are to be connected at the bottom part of the smaller depth part of the case.

4 Claims, 8 Drawing Figures

TIME DELAY SWITCH

BACKGROUND OF THE INVENTION

1. Field of the Invention

The present invention relates to an improvement in a time delay switch provided with an oil dash pot as a time delaying means.

2. Description of the Prior Art

Time delay switches works, for example to put a light off several minutes after a switch-off operation of a switch handle. Such switches are useful for lights of corridors or staircases or ventilators of a lavatory.

Recently, such delay time switch have been made to provide an oil dash pot as a time delay mechanism.

If such time delay switch is designed in a size of a single unit switch module alloted for ordinary simple home use wall switch for commercial power line, since the time delay mechanism using the oil dash pot delay means takes a certain space in the enclosure case of the switch, in order to afford as much room as possible for the switch the enclosure case must be made very thin, and such thin enclosure case has to be made of a thermoplastic resin which has higher durability against mechanical shock than a thermosetting resin. However, the thermo plastic resin has a problem that it has lower temperature resistivity and lower electric insulation than the thermosetting resin, and therefore, if the time delay switch is made by using the enclosure case of the thermoplastic resin, the durability is not sufficient.

SUMMARY OF THE INVENTION

The present invention can provide a reliable time delay switch, which can belatedly switch off or on a circuit after a switch off or on operation of its handle.

Also, the present invention can provide a reliable time delay switch, which can on one hand belatedly switch off a circuit after a switch-off operation of its handle by a predetermined delay time and on the other hand switch off another circuit instantaneously at the time of switch-off operation of the handle.

DESCRIPTION OF THE PREFERRED EMBODIMENTS

Time delay switch in accordance with the present invention comprises a delay action means comprising an oil dash pot containing a piston of magnetic-flux-responsive substance disposed in a oilfilled cylinder, a magnetic circuit containing a permanent magnet mechanically linked to a handle and magnetically coupled to the piston, at least a fixed magnetic yoke, at least a moving magnetic yoke and an armature movable in reaction to a change of magnetic flux due to movement of the piston, at least a moving contact plate linked to the armature and at least a fixed contact plate disposed to touch the moving contact plate, a case which contains the abovementioned components therein and has at least a terminal connected to the moving contact plate and another terminal connected to the fixed contact plate, wherein the improvement is that the case is made of an insulating resin and has a first part of larger depth and a second part of smaller depth, the first part and the second part being each other integrally connected, the first part containing the oil dash pot fixed to the bottom part of the case, the handle cradlably fulcrumed on an upper part of the first part, and the moving contact plate and the fixed contact plate of the time delay switch, the second part containing the terminals to which electric wires are to be connected on the bottom part of the smaller depth part of the case.

The present invention is elucidated in the following, referring to the accompanied drawings.

As shown in FIG. 1 to FIG. 5, showing a first embodiment, an enclosure case 1 comprises a first part 101 of larger depth and a second part 102 of smaller depth.

Both the first and the second parts 101, 102 of the case 1 are integrally formed by molding a thermo-setting synthetic resin. The first part and the second part 102 each has a size in plan view corresponding to a size of single module of ordinary home use wall switch for use in commercial power line, so that the time delay switch in accordance with the present invention can be held occupying two unit spaces of the modules of ordinary home use switch holding box and switch holding flame therefor, which are designed usually for holding three modules or six modules of ordinary home use wall switches.

Figure 1:
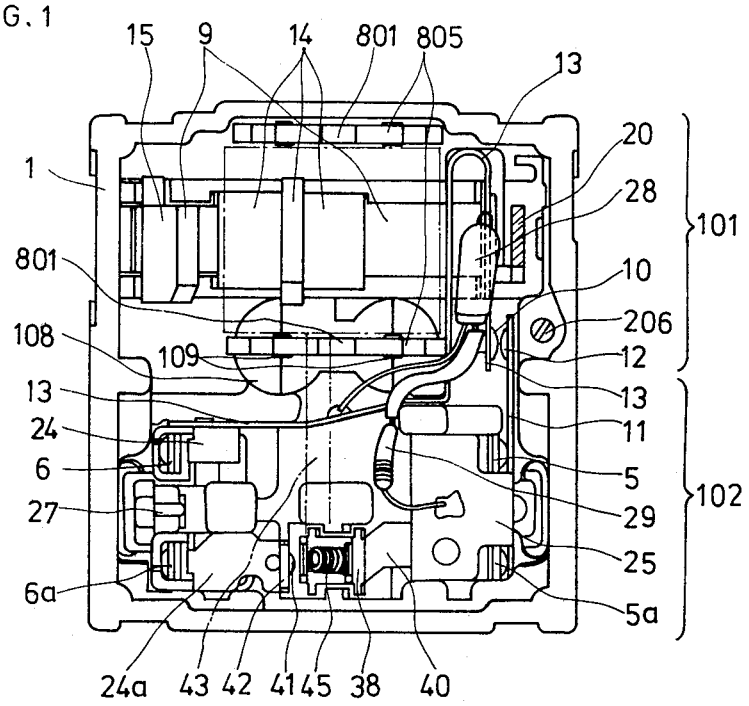
FIG. 1 is a plan view of a first embodiment with a cover 7 and a handle 8 and the attached components removed.
Figure 3:
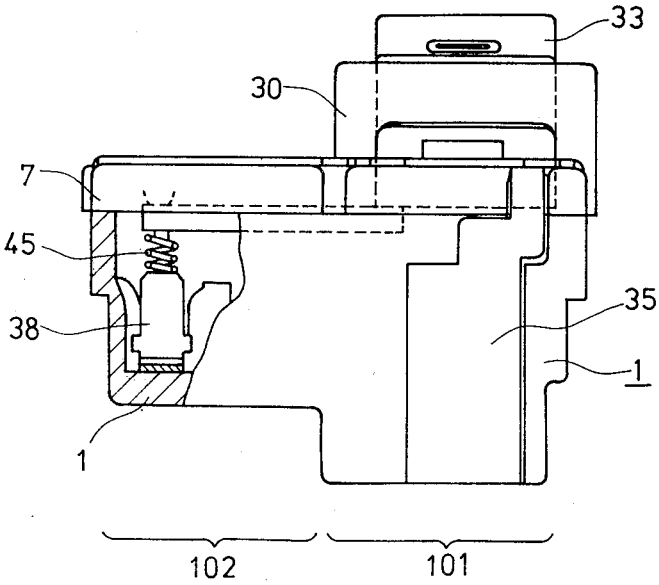
FIG. 3 is a partially fragmental side view of the first embodiment.
Figure 2:
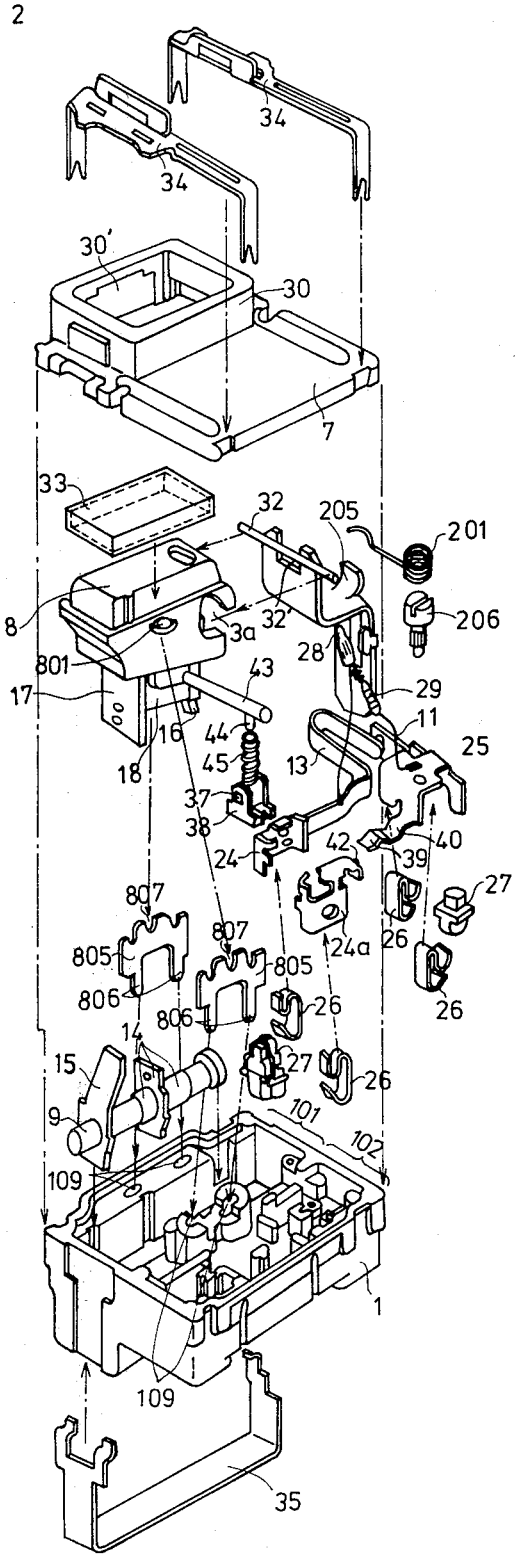
FIG. 2 is an exploded perspective view of the embodiment of FIG. 1.
Figure 4:
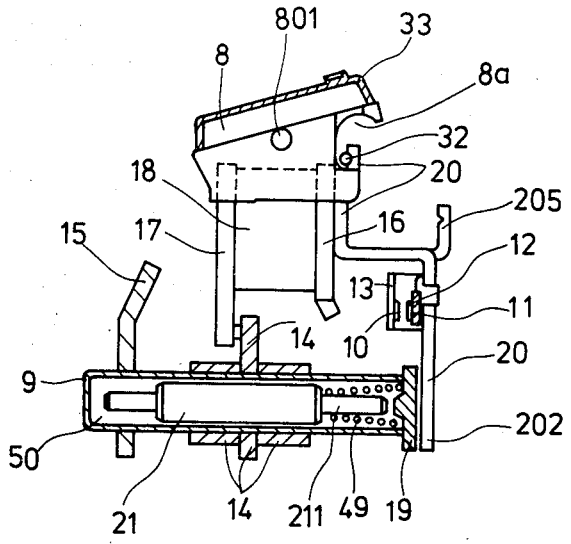
FIG. 4 is a side view of a principal part of a magnetic circuit of the embodiment when the switch is in OFF state.
Figure 5:
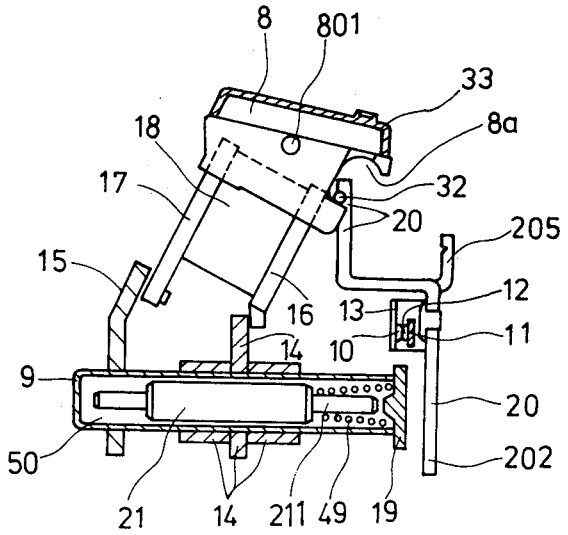
FIG. 5 is a side view of the principal part of the magnetic circuit of the embodiment when the switch is in ON state.

The first part 101, which has a larger depth contains an oil dash pot 9 fixed on the bottom part of the case 1. The oil dash pot 9 has therein a plunger piston 21 made of a magnetic-flux-responsive substance such as iron and an impeding oil 50 filled in the cylinder 94. A compression spring 49 is preferably provided so as to push the plunger piston 21 leftward (to depart from a pole piece 19) in order to accelerate restoration of the piston 9. A moving contact plate 13 is disposed above the oil dash pot 9, and a fixed end thereof is fixed to a terminal 6 disposed in the second part 102. A moving contact 10 of a moving contact plate 13 is disposed facing to a fixed contact 12 of the fixed contact plate 11, and a fixed end thereof is fixed to a common terminal block 25 in the second part 102. The common terminal block 25 has the proper terminal 6 and a relay terminal 6*a*. The time delay structure comprises as shown in FIGS. 4 and 5, the oil dash pot 9, a permanent magnet 18 fixed to a handle 8, yokes 16 and 17 fixed on both pole faces of the permanent magnet 18, an armature 20 fulcrumed by a fulcrum pin 32 at a part near the yoke 16 under the handle 8 movably at its moving end 201, the armature 20 being pushed rightwards (do depart from the pole piece 19) by the moving end of the moving contact plate 13, a central yoke 14 fixed on the central part of the oil dash pot 9, and a restoration yoke 15 fixed on the left end part of the oil dash pot 9. The delay structure operates as follows. When the handle 8 is positioned as shown in FIG. 4, the moving end of the moving contact 10 is pushed leftwards by the armature 20 and hence depart from the fixed contact 12, thereby making the switch OFF; and when, on the contrary, the handle 8 is positioned as shown in FIG. 5, the armature 20 leaves the moving contact 10 by a force of a spring 201, which is held on a spring holder 206 and pushing a projection 205 rightwards, thereby allowing it to touch the fixed contact 12 to make the switch ON. The principle of such movement is that, when the handle 8 is in the position of FIG. 5, the magnetic flux of the permanent magnet 18 flows in a magnetic circuit of one pole of permanent magnet 18—yoke 16—central yoke 14—plunger piston 21—restoration yoke 15—the other pole of permanent magnet 18. Since the magnetic flux is short-circuited by the plunger-piston 21 in this ON state, the armature 20 has no magnetic flux flowing therein, and therefore the armature 20 is pushed rightward by a spring action of the spring 201, and hence the moving contact 10 touches the fixed contact 12 thereby making the switch ON. Switching OFF is realized by an action that, by turning the handle 8 anticlockwise in FIG. 5 to the state of FIG. 5, the magnetic circuit is switched to disconnect the yoke 17 from the restoration yoke 15. By the disconnection of the restoration yoke 15 from the yoke 17, the magnetic flux flowing between the central yoke 14 and the restoration yoke 15 through the plunger piston 21 is cut off, and the magnetic flux changes its flow to a path through the magnetic circuit of permanent magnet 18—yoke 16—armature 20—gap between the moving end tip 202 of the armature—pole piece 19 of the oil dash pot 9—narrow extended part of the plunger piston 211—plunger piston 21—central yoke 14—yoke 17—permanent magnet 18. By means of this flux, the plunger piston 21 travels rightwards resisting to the spring 49 and at an oil-impeded slow speed, and after several minutes, reaches the pole piece 19. Then, by touching of the end tip of the plunger piston 21 to the pole piece 19, the reluctance between the pole piece 19 and the armature end tip 202 much increases, and hence the armature is attracted to the pole piece 49. This leftwards motion of the armature drives the moving end of the moving contact plate 13 leftwards and makes the moving contact 10 depart from the fixed contact 12, thereby to make the switch OFF. The moving contact plate 13 is foemed to have a U-shaped bent part 23 so as to have a spring action by which the switch becomes normally on unless the contact plate 13 is pushed leftwards by the armature 20 at its attracted position. A terminal **24*a* is disposed near the terminal 24 in a relation isolated therefrom. An instant action switch, which is operated to switch on or off instantaneously with motion of the handle 8, is formed by a snap-action moving contact 38 disposed on a fulcrum 39 of the extended part of the terminal 25 and a fixed contact 41 disposed on an extended part of the terminal block 24*a*. The snap action mechanism is provided by engaging the moving contact 38, which is fulcrumed on a metal fulcrum 39, to one end of a compression spring 45, whose other end is linked to a driving bar 43 projecting from the handle. The metal fulcrum 39 is disposed on the bottom face of the shallower second part 102 of the case 1. The instant action switch is switched ON simultaneously with the switching ON of the delay time switch formed by the contacts 10 and 12 at the clockwise motion of the handle 8, and is switched OFF simultaneously with the reverse operation (anticlockwise motion) of the handle 8, apart from and hence prior to the switching OFF of the delay time switch. The terminals 24, 24*a* and 6, are spring-lock type terminals each of which comprises a C-shaped locking spring 26 which locks an end tip part of lead wire put thereinto through the holes on the case bottom. The common terminal block 25 further has an auxiliary locking spring 26 for constituting the relaying terminal 6*a*. Numerals 27 and 27' designate unlockers which are pins made of insulating plastic and works to push the locking springs 26 by a plying thereof, thereby fastening of end tip of the lead wires from the terminals 24, 24*a*, 6 and 6*a*. The unlocking can be made by plying the unlocker 27** to the center of the case and pulling down the lead wires.

The handle 8 is made of a translucent plastic substance and has projections 801 as shaft on both side faces thereof. A pair of bearing plates 805 is provided in the first part 101 to receive the projections 801, is made of a shock and abrasion resistive substance for durability, but should be of non magnetic-flux-responsive material, in order not to disturb the magnetic flux of the magnetic circuit. Suitable substance is, for example, brass plate. The bearings 805 are mounted on both sides of the oil dash pot 9 by inserting their legs 806 into the holes 109 on walls and a column 108 of the case 1. The bearing holes 807 of the bearings 805 to receive the shafts may be a semicircular recess, since the upper face of the shaft can be suppressed by the lower face of a lid of the case 1. Since the bearings 805 are made of strong material such as metal, the durability of the handle bearing increases, and hence, the lifetime of the switch becomes longer; furthermore, due to stable bearing by the strong bearing plates, a highly stable time delay motion is attainable. A small glow discharge lamp 28 of very small power consumption such as a neon lamp is disposed under the handle 8, in a manner that the light of the glow discharge lamp 28 illuminate the handle 8 from its lower face and the light diffuse through the translucent handle body 8, so that the user can easily find the switch handle 8 in the dark.

In order to assure illumination of the neon lamp light to the handle 8, an opening 32 is formed at the top part of the armature 20. The neon lamp 28 is connected in series with a resistor 29 across the moving contact plate 13 and the terminal 25.

A cover 7 of an insulation substance having an opening 30' in a handle receiving projection 30 is disposed on the case 1 in a manner to expose the upper face of the handle 8 from the opening 30'. A handle cover 33 of transparent substance is provided on the handle 8.

A magnetic shield plate 35 of an iron or the like ferromagnetic substance is provided to surround the first part 101 of the case, in order to prevent maloperation of the delay means by external magnetic field. A apair of fastening metal bands 34, 34 are provided to fix the cover 7 and the magnetic shield 35 to the case 1. As has been elucidated, the case 1 of the present delay switch is made to occupy two spaces of unit modules of ordinary home use type wall switch of commercial power supply, the room inside the enclosure case 1 is enough, and therefore, there is no need of to design the wall and bottom of the enclosure case thinner than ordinary switches to contain the time delay mechanism. Therefore, it is possible to use the thermosetting synthetic resin for the enclosure case, thereby assuring a higher insulation characteristic and higher temperature resistivity than a use of thermo plastic resin which has to be used when only little thickness of the case wall is allowable. Furthermore, by use of the two unit spaces 101 and 102 of the switch module, it becomes possible to form the relaying or connecting terminal 5*a* which could not be formed if a time delay switch is structured only in a single unit of the switch module.

Figure 6:
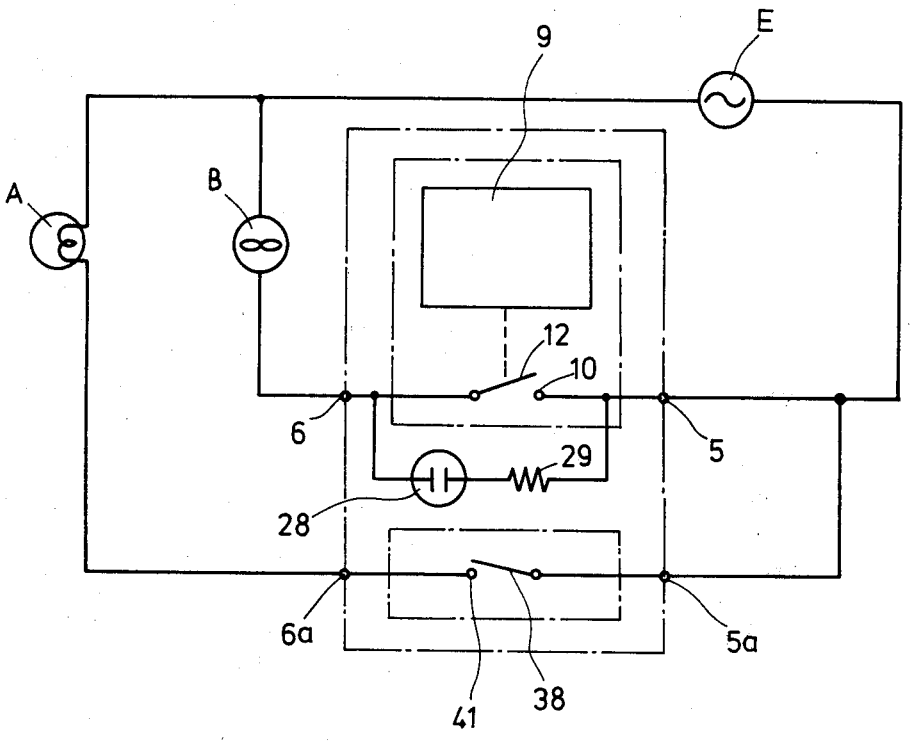
FIG. 6 is a circuit diagram of the switch of the first embodiment.

The circuit diagram of this first embodiment is shown in FIG. 6 wherein the block C shows the switch of the present invention, a lamp A is connected via the instant switch terminal 6*a* and a lavatory ventilator B is connected via the moving contact terminal 6. E designates an AC power source. The time delay switch DS controlled by the oil dash pot belatedly opens the ventilator circuit. Therefore the ventilator B can evacuate the lavatory smell after switching OFF of the lamp A.

Figure 7:
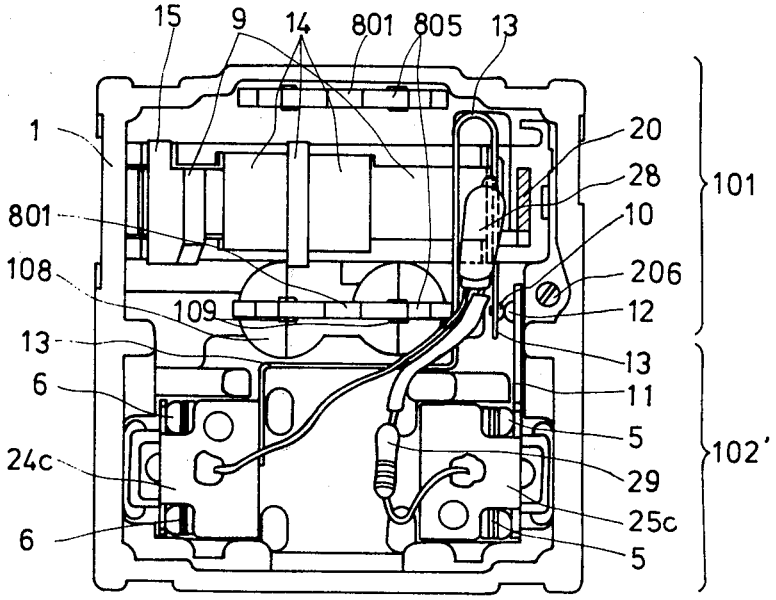
FIG. 7 is a plan view of a second embodiment with a cover 7 and a handle 8 and the attached components removed.
Figure 8:
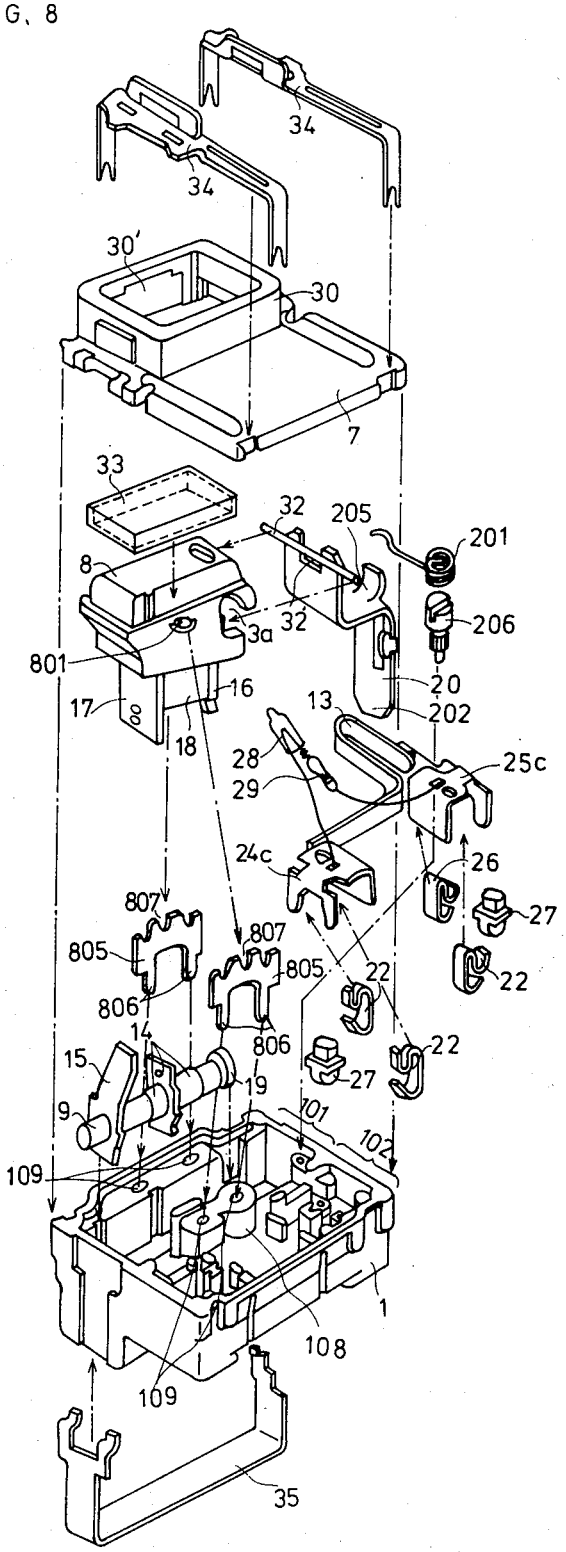
FIG. 8 is an exploded perspective view of the embodiment of FIG. 7.

FIG. 7 and FIG. 8 show a second embodiment wherein the structure in the first part (time delay switch part) is substantially similar to that of the first embodiment, but the structure in the second part 102' (terminal part) is different such that the second embodiment has only a pair of terminal 24*c* and 25*c*, and there is no moving contact 38 nor its driving bar 43. The first terminal 24*c* is for connecting the moving contact plate 13 to the exterior electric wire and the second terminal 25*c* is for connecting the fixed contact plate 11 to the exterior electric wires. Each of both terminals 24*c* and 25*c* comprise a pair of wire grasping springs, so that both terminals can serve relaying terminals.

The time delay switch of the second embodiment has a single circuit time delay switch, and can be used for example in a lighting circuit of a corridor or a staircase or an entrance hall. The neon lamp 28 illuminates the handle 8 so that the user can easily find the handle 8 in the dark, when a lamp to be switched by the time delay switch is put off.

What is claimed is:

1. A time delay switch comprising:

a delay action means comprising an oil dash pot containing a piston of magnetic-flux-responsive substance disposed in an oil-filled cylinder, a magnetic circuit containing a permanent magnet mechanically linked to a handle and magnetically coupled to said piston, at least a fixed magnetic yoke, at least a moving magnetic yoke and an armature movable in reaction to a change of magnetic flux due to movement of the piston, at least a moving contact plate linked to said armature and at least a fixed contact plate disposed to touch said moving contact plate, a case which contains the abovementioned components therein and has at least a terminal connected to the moving contact plate and another terminal connected to said fixed contact plate, wherein the improvement is that said case is made of an insulating resin and has a first part of larger depth and a second part of smaller depth, said first part and said second part being each other integrally connected, said first part containing said oil dash pot fixed to said bottom part of said case, said handle cradlably fulcrumed on an upper part of said first part, and said moving contact plate and said fixed contact plate of said time delay switch, said second part containing said terminals to which electric wires are to be connected at the bottom part of the smaller depth part of the case.

2. A time delay switch in accordance with claim 1, which further comprises:

an instant motion switch driven by said handle, thereby constituting two interlocked switches which are simultaneously operated in one direction and inverse operated in at two different timings.

3. A time delay switch in accordance with claim 1, wherein said second part contains one common terminal at one end thereof, two other terminals on the other end thereof and an instant motion switch at the inbetween part, two contacts of said instant motion switch being connected between said common terminal and a first one of said two other terminals, a driven point of said instant motion switch being connected to a driving point of an interlocking bar connected to said handle, and one of said fixed contact plate and the moving contact plate being connected to the common terminal and the other one thereof is connected to a second one of said two other terminals.

4. A time delay switch in accordance with claim 1 or 2, wherein said handle is made of a translucent substance, said armature has a light passing opening, and a glow discharge lamp is disposed under the handle in a position to send its light through said opening to said handle.

* * * * *